US006582049B2

(12) United States Patent
Cook

(10) Patent No.: US 6,582,049 B2
(45) Date of Patent: Jun. 24, 2003

(54) METHOD AND APPARATUS FOR DETECTING THE POSITION OF AN INKJET PRINTHEAD

(75) Inventor: William Paul Cook, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/870,532

(22) Filed: May 31, 2001

(65) Prior Publication Data

US 2002/0180821 A1 Dec. 5, 2002

(51) Int. Cl.[7] ..... B41J 29/393; B41J 29/38

(52) U.S. Cl. ..... 347/19; 347/14

(58) Field of Search ..... 347/19, 37, 14, 347/9, 12, 10, 11, 23, 15, 17, 39, 20, 51, 52; 400/279, 579, 705, 322

(56) References Cited

U.S. PATENT DOCUMENTS

| | | | | |
|---|---|---|---|---|
| 4,709,244 | A | 11/1987 | Piatt et al. | 347/19 |
| 4,922,270 | A | 5/1990 | Cobbs et al. | 347/19 |
| 5,250,956 | A | 10/1993 | Haselby et al. | 347/19 |
| 5,289,208 | A | 2/1994 | Haselby | 347/10 |
| 5,297,017 | A | 3/1994 | Haselby et al. | 347/19 |
| 5,404,020 | A | 4/1995 | Cobbs | 347/19 |
| 5,448,269 | A | 9/1995 | Beauchamp et al. | 347/19 |
| 5,451,990 | A | 9/1995 | Sorenson et al. | 347/12 |
| 5,508,826 | A | 4/1996 | Lloyd et al. | 347/14 |
| 5,587,728 | A | 12/1996 | Edgar | 347/9 |
| 5,600,350 | A | 2/1997 | Cobbs et al. | 347/12 |
| 5,627,570 | A | 5/1997 | Hiramatsu et al. | 347/19 |
| 5,644,344 | A | 7/1997 | Haselby | 347/19 |
| 5,764,251 | A | 6/1998 | Hashimoto | 347/19 |
| 5,796,414 | A | 8/1998 | Sievert et al. | 347/11 |
| 5,825,378 | A | 10/1998 | Beauchamp | 347/10 |
| 5,825,381 | A | 10/1998 | Choo | 347/7 |
| 5,835,108 | A | 11/1998 | Beauchamp et al. | 347/19 |
| 5,841,448 | A | 11/1998 | Moriyama et al. | 347/19 |
| 5,847,722 | A | 12/1998 | Hackleman | 347/13 |
| 5,856,833 | A | 1/1999 | Elgee et al. | 347/19 |
| 5,883,646 | A | 3/1999 | Beauchamp | 347/12 |
| 5,905,512 | A | 5/1999 | Beauchamp | 347/23 |
| 5,975,674 | A | 11/1999 | Beauchamp et al. | 347/14 |
| 5,980,016 | A | 11/1999 | Nelson et al. | 347/19 |
| 6,076,915 | A | 6/2000 | Gast et al. | 347/19 |

*Primary Examiner*—Lamson Nguyen
*Assistant Examiner*—Charles W. Stewart, Jr.

(57) ABSTRACT

An inkjet printhead position detection system includes a light emitting device emitting at least one beam of light having a first edge and a second edge nonparallel to the first edge. An inkjet printhead includes a light detecting device detecting the at least one beam of light as the inkjet printhead scans across the light. A time period between when the light detecting device crosses the first edge of the at least one light beam and when the light detecting device crosses the second edge of the at least one light beam is dependent upon a position of the inkjet printhead.

41 Claims, 14 Drawing Sheets

METHOD AND APPARATUS FOR DETECTING THE POSITION OF AN INKJET PRINTHEAD

BACKGROUND OF THE INVENTION

1. Field of the Invention

The present invention relates to a method and apparatus for detecting the position of a component in an inkjet printer, and, more particularly, to a method and apparatus for detecting the position of a printhead in an inkjet printer.

2. Description of the Related Art

The alignment of inkjet printheads in an inkjet printer is usually achieved by controlling the tolerances during the manufacture of the printhead and printer. As printheads increase in size and customer quality expectations increase, aligning inkjet printheads solely by controlling tolerances becomes increasingly expensive.

A normal ink jet printer uses a scanning carriage to move the printhead back and forth across the print medium. After each printing pass, the medium is moved forward and stopped for the next print pass. To achieve full color output, three or four primary color printheads are used, with a full range of color achieved by mixing the primary colors in various proportions. When a single, integrated printhead contains all of the primary colors (such as cyan, magenta and yellow), their relative alignment on the final output is very well controlled, since their relative placement is controlled by existing photolithography processes and numerically controlled laser devices. However, as the need for higher throughput increases, the number of nozzles increases, and the possibility of integrating the various colors in a monolithic device becomes unfeasible. The drops of ink from each primary color are then generated from separate devices, and their relative placement is controlled by automatic placement equipment that has much looser tolerances. Even when the separate devices are placed on a single printhead unit, the achievement of tolerances approaching a pixel between colors is very difficult. If each color is placed on a separate printhead, and they are joined on a carriage assembly, the relative placement accuracy is even worse.

In existing printers, test pages are sometimes generated which can be used to adjust the relative placement of each color. This solution becomes less effective in a business inkjet environment, when less user intervention is desired, and consistent operation is expected when various supplies, such as a printhead, are replaced.

What is needed in the art is a method of automatically detecting the positions of printheads in both a scan direction and a paper feed direction, as well as the skew angle of each printhead relative to the paper feed direction. Printed information can then be automatically corrected for position and skew as shown in related application Ser. No. 09/827,805 filed on Apr. 6, 2001.

SUMMARY OF THE INVENTION

The present invention provides a sensor arrangement in an inkjet printer that produces direct feedback to correct for misalignment of printheads.

The invention comprises, in one form thereof, an inkjet printhead position detection system including a light emitting device emitting at least one beam of light having a first edge and a second edge nonparallel to the first edge. An inkjet printhead includes a light detecting device detecting the at least one beam of light as the inkjet printhead scans across the light. A time period between when the light detecting device crosses the first edge of the at least one light beam and when the light detecting device crosses the second edge of the at least one light beam is dependent upon a position of the inkjet printhead.

The invention comprises, in one form thereof, a method of detecting a position of an inkjet printhead, including emitting at least one light beam having a first edge and a second edge, the second edge being nonparallel to the first edge. A light detecting device is provided on the inkjet printhead. The inkjet printhead is scanned across the light. The first edge of the light beam is detected with the light detecting device during the scanning step. The second edge of the light beam is detected with the light detecting device during the scanning step. The position of the inkjet printhead is calculated dependent upon a time period between the detecting steps.

An advantage of the present invention is that the positions of printheads can be sensed in both a scan direction and a paper feed direction.

Another advantage is that the detection of printhead position can be performed automatically, i.e., without the need for human intervention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
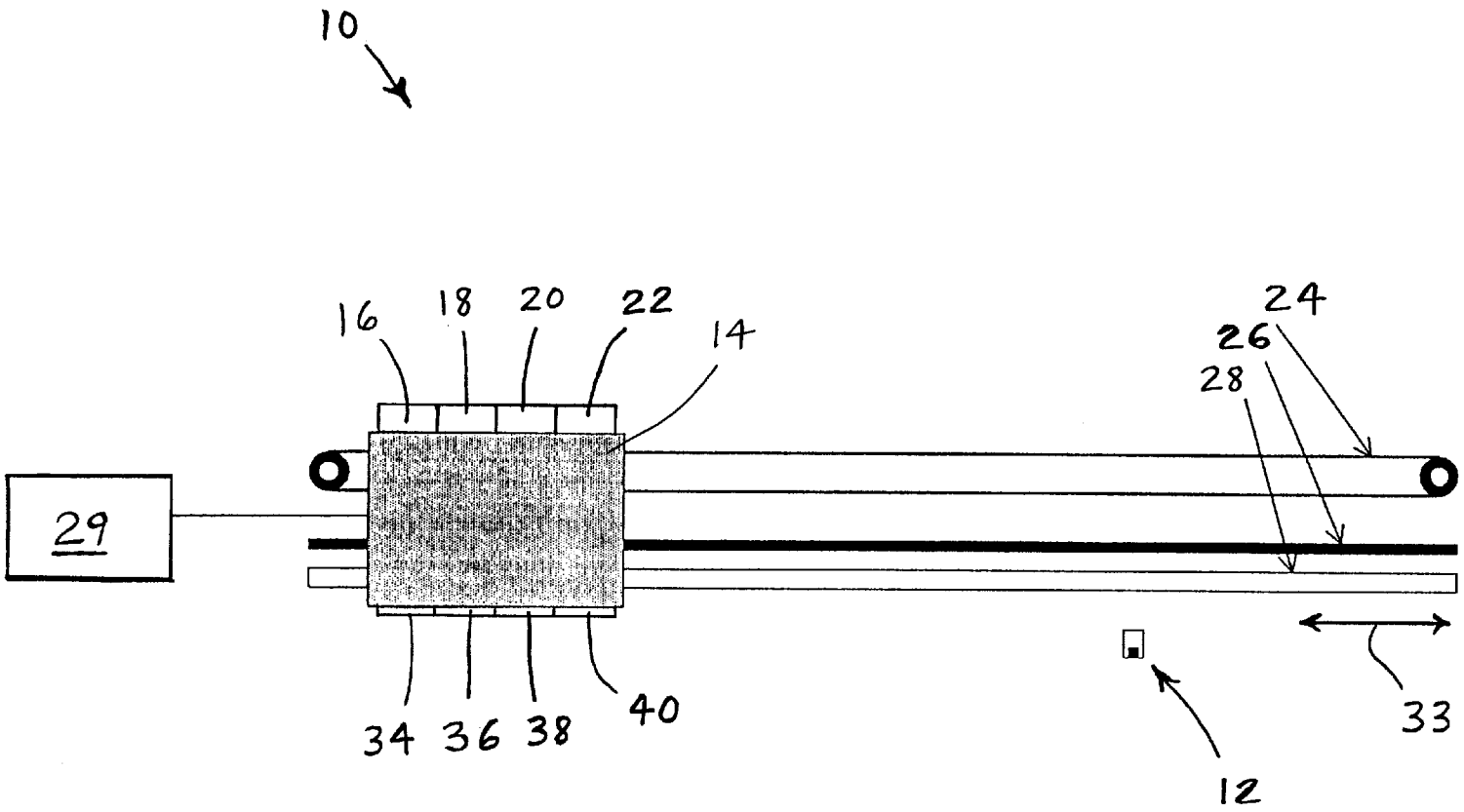
FIG. 1 is a schematic, front view of one embodiment of a printhead position detection system of the present invention.

Referring now to the drawings and particularly to FIG. 1, there is shown one embodiment of a printhead position detection system 10 of the present invention. Detection system 10 includes a fixed position light source assembly 12, a carriage 14 carrying four printheads 16, 18, 20, 22, a drive belt 24, an optical encoder 26, a guide rod 28 and a microcontroller 29.

Figure 2:
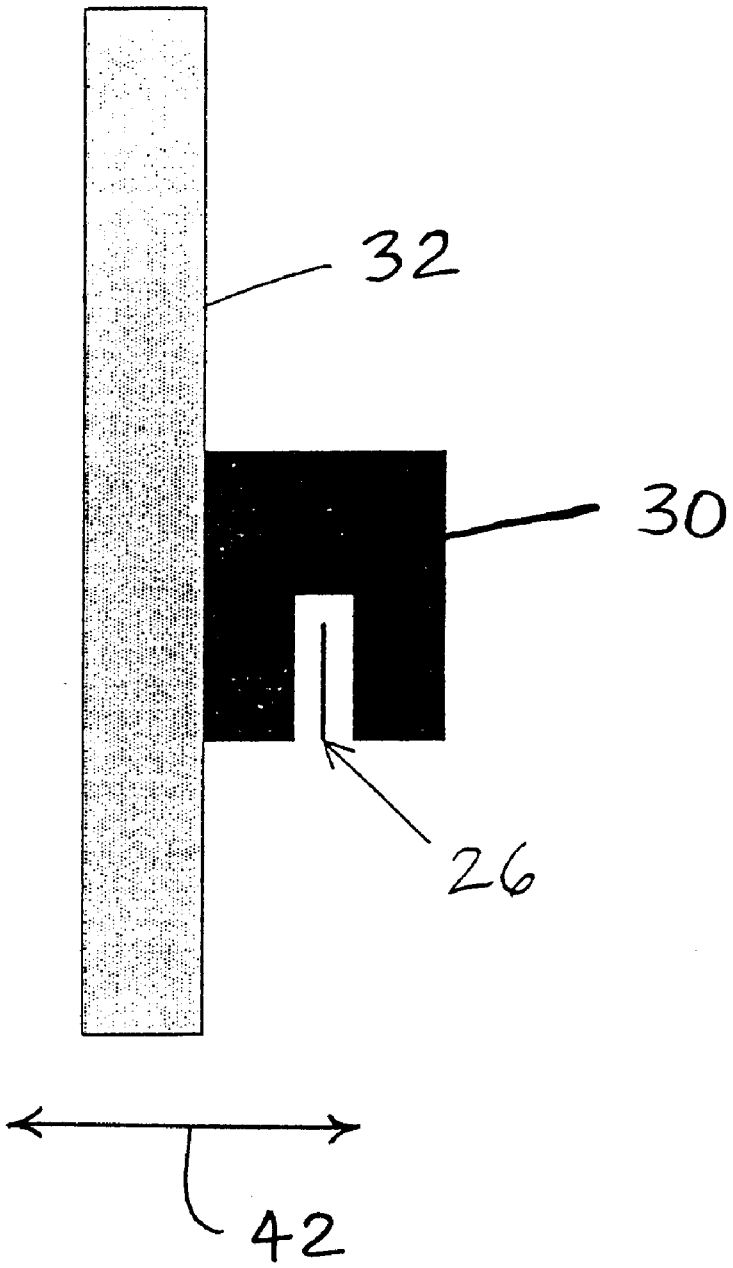
FIG. 2 is a schematic, side view of the optical encoder, optical encoder sensor and rear wall of the carriage of FIG. 1.

Carriage 14 is driven along guide rod 28 by drive belt 24. The lateral position of carriage 14 along guide rod 28 is derived from optical encoder strip 26 and an optical encoder sensor 30 (FIG. 2) which is attached to a wall 32 of carriage 14. Guide rod 28 is oriented parallel to a scan direction of carriage 14, which is indicated by double arrow 33 in FIG. 1.

Each of printheads 16, 18, 20 and 22 includes a respective light sensing position sensor 34, 36, 38, 40. The outputs of position sensors 34, 36, 38, 40 are used by microcontroller 29 to determine the relative location of each printhead 16, 18, 20, 22 in two directions, i.e., the carriage scan direction 33 and a paper feed direction indicated by double arrow 42 in FIG. 2. Scan direction 33 is perpendicular to paper feed direction 42.

Figure 3:
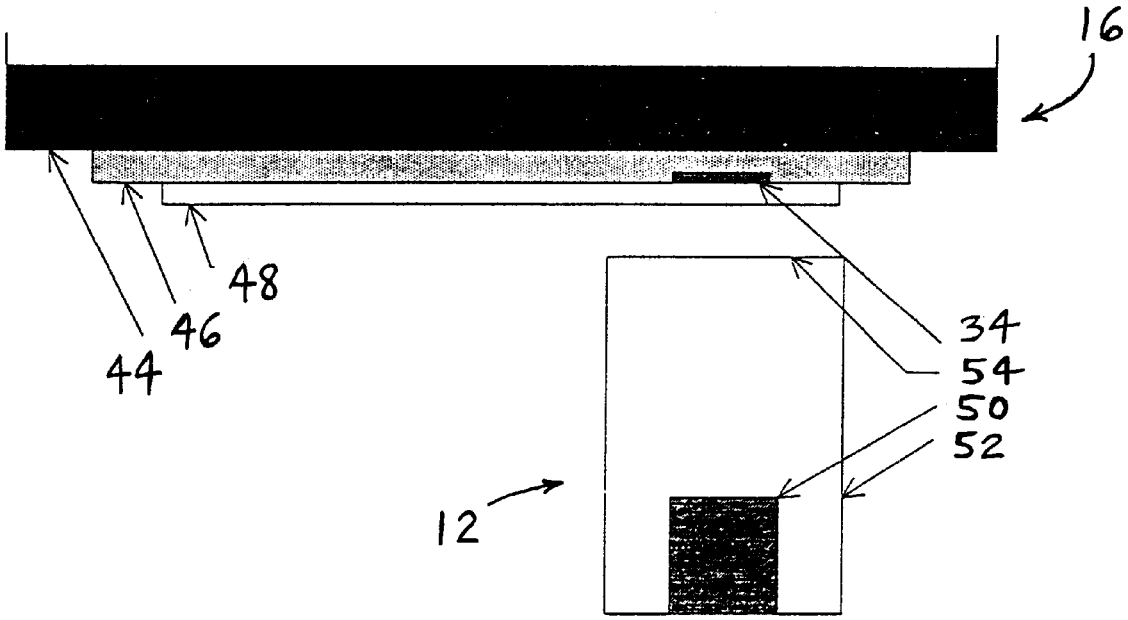
FIG. 3 is an enlarged, fragmentary, schematic side view of the printhead position detection system of FIG. 1.

The structure of each of printheads 16, 18, 20, 22 and their associated position sensors 34, 36, 38, 40 is substantially identical. Thus, the structure of only printhead 16 and its position sensor 34 will be described in further detail herein. FIG. 3 is a more detailed view of printhead 16 as it is positioned above fixed position light source assembly 12. Printhead 16 includes a body 44, a heater chip 46 having position sensor 34 embedded therein, and a nozzle plate 48.

Figure 4:
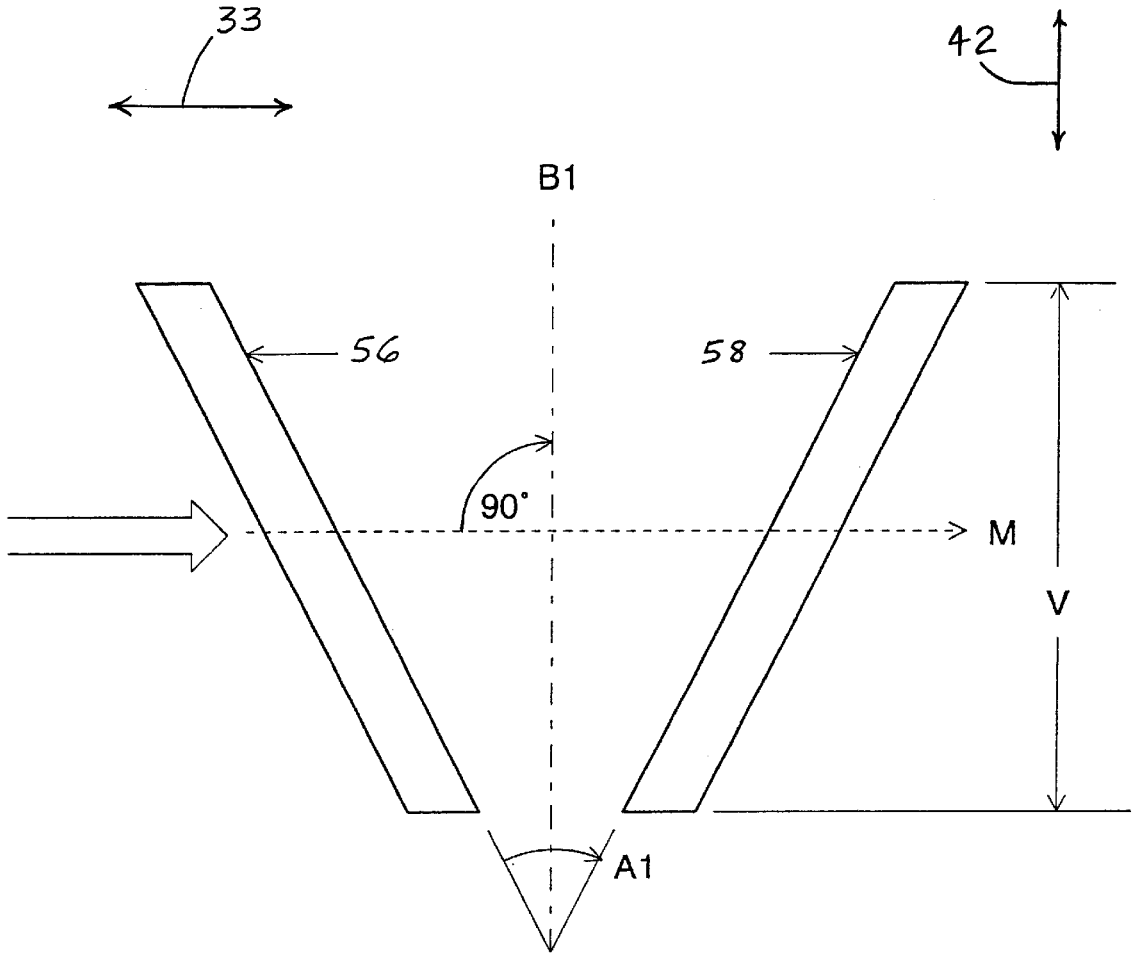
FIG. 4 is an enlarged, top view of the apertures of the light source assembly of FIG. 3.

Light source assembly 12 includes a light source 50 disposed in a housing 52 having an aperture plane 54. Apertures 56 and 58 (FIG. 4) in aperture plane 54 are disposed above light source 50, which may include a lens, and are used to create a well-defined light image with distinct edges on the bottom of nozzle plate 48. Apertures 56 and 58 produce respective light beams having edges corresponding to the four sides of each of apertures 56, 58. Apertures 56 and 58 can be created in aperture plane 54 by use of a photomask (not shown), similar to that used in photolithography. Other methods could be used, such as cutting or etching though a metal mask.

Apertures 56, 58 are in the form of two strips or slits with a relative angle A1. The direction of movement M of carriage 14 is perpendicular to a line B1, which bisects angle A1. A slit length V determines the detection range in paper feed direction 42 of position sensor 34.

Figure 5:
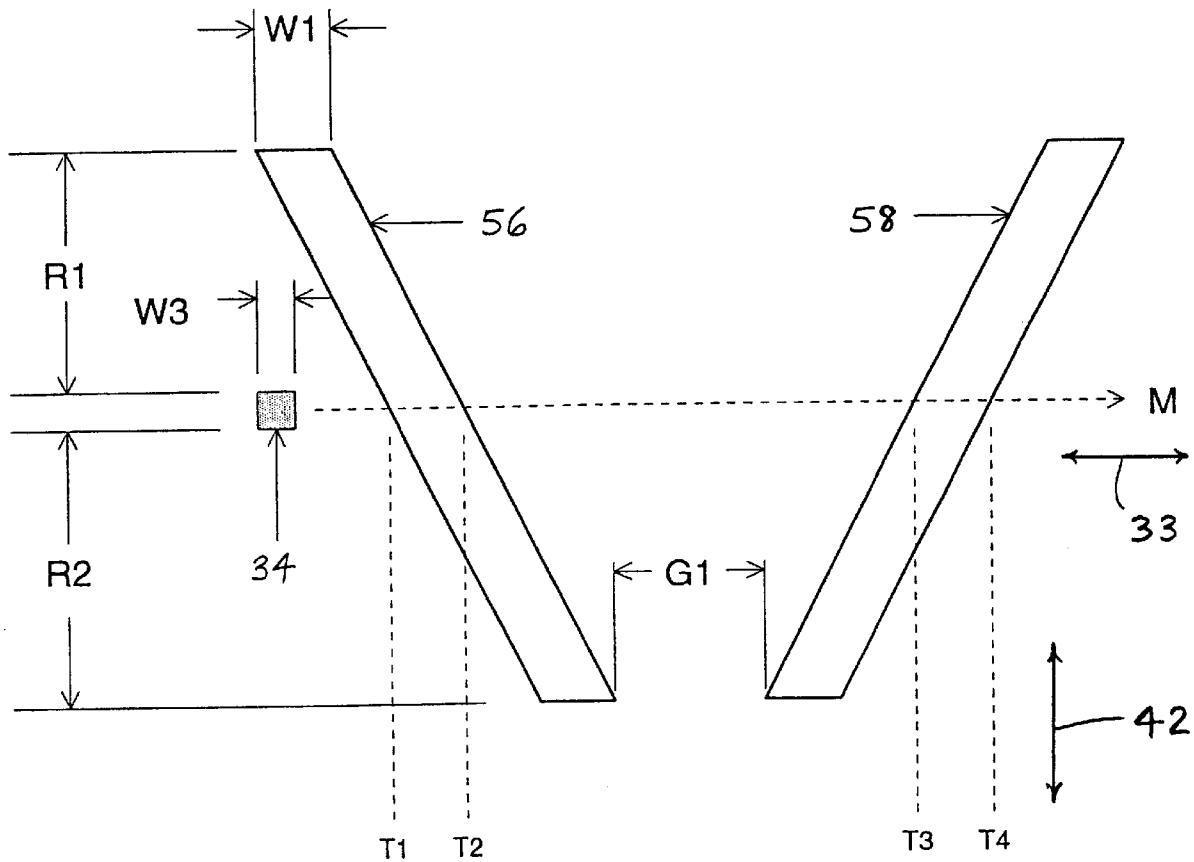
FIG. 5 is an enlarged, top view of the apertures of the light source assembly and the position sensor of FIG. 3.

FIG. 5 shows position sensor 34 and apertures 56, 58 together. Sensor 34 follows path M across apertures 56, 58, generating output transitions at times T1, T2, T3 and T4 when sensor 34 crosses an edge of one of the light beams. A width W3 of sensor 34 is much less than a slit width W1 of aperture 56, so the sensor output signal changes relatively quickly between its minimum and maximum at each of times T1, T2, T3 and T4. The lateral position of printhead 16 in scan direction 33 is determined from the average of times T1 and T4. Times T2 and T3 could be included in the calculation for more accuracy or noise suppression. The position of printhead 16 in paper feed direction 42 is determined from the difference between times T1 and T4. Again times T2 and T3 could be included in the calculation. R1 and R2 show the detection range in paper feed direction 42. Reversing carriage direction and collecting four more transition times may further improve accuracy, especially if the sensor has any hysteresis. Gap G1 is set greater than W3 if times T2 and T3 are used. The sensor sensitivity in paper feed direction 42 (value of T4 minus T1) is controlled by angle A1. Small angles are to be avoided due to poor sensitivity, while angles above 120° cause slower signal transitions at times T1 through T4, and thus reduce accuracy. Preferred angles A1 are between 45° and 90°.

The intensity of light source 50 and the area of position sensor 34 must be great enough to achieve an adequate signal for amplification and comparison. Else, expensive electronics may be required to manipulate the signal at increased system cost. However, simply increasing the area of position sensor 34 causes slower signal transitions at times T1 through T4, and can also reduce the position accuracy.

Figure 6:
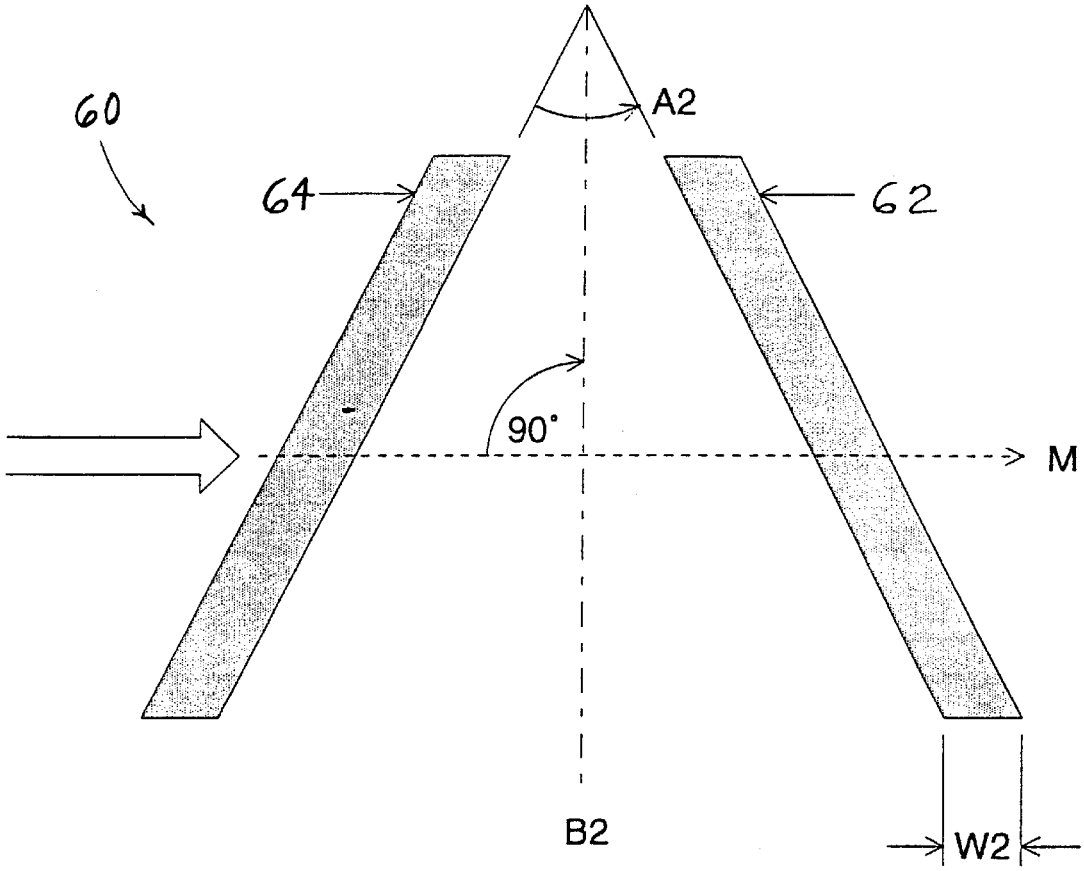
FIG. 6 is an enlarged, bottom view of another embodiment of a position sensor assembly of a printhead position detection system of the present invention.

In another embodiment, a position sensor assembly 60 (FIG. 6) overcomes the problems discussed above. Sensor assembly 60 includes two elongate, nonparallel sensors 62 and 64. Sensors 62 and 64 are shaped similarly to apertures 56, 58, except that sensor assembly 60 is rotated 180° relative to apertures 56, 58. Sensor 62 is the leading sensor, as it will generate an output first. A line B2 bisects an angle A2 defined between sensors 62, 64. Sensors 62, 64 are arranged such that direction of carriage movement M is perpendicular to line B2. Angle A2 is set equal to angle A1 between apertures 56, 58 for best position sensing operation.

Figure 7:
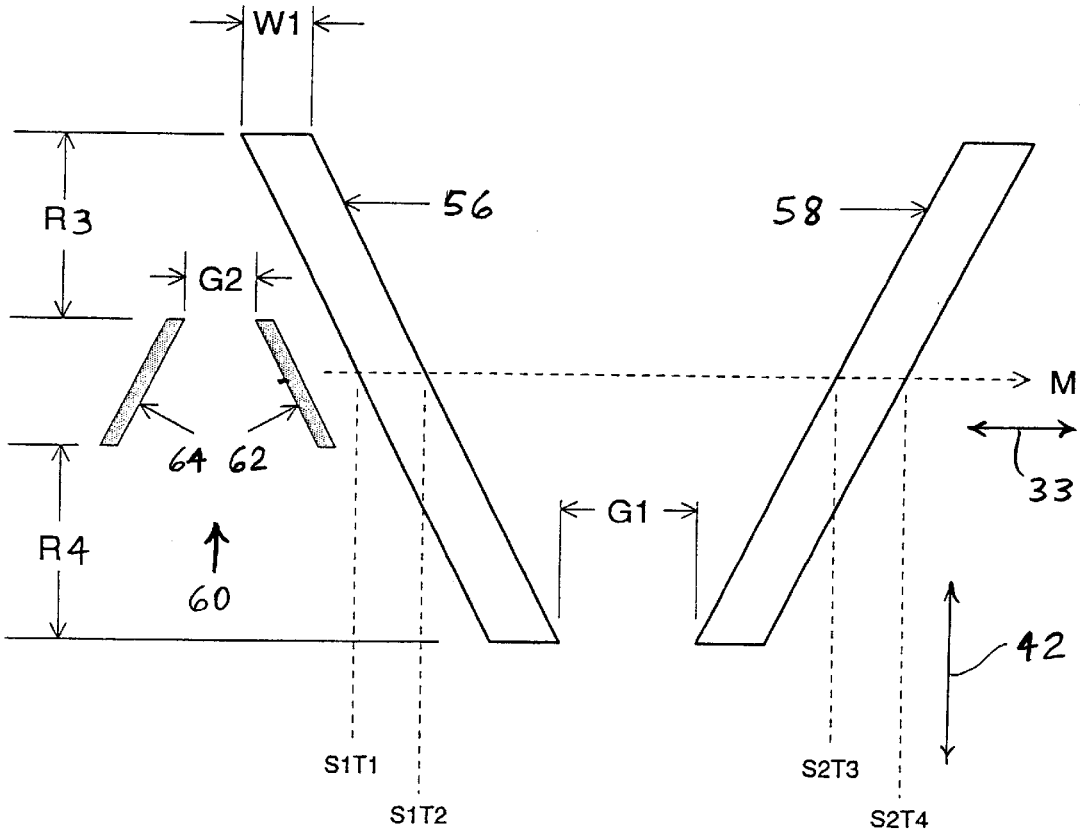
FIG. 7 is an enlarged, top view of the apertures of the light source assembly of FIG. 3 and the position sensor assembly of FIG. 6.

Both sensor assembly 60 and apertures 56, 58 are shown in FIG. 7. As sensors 62, 64 travel along path M, the two sensors generate several output signals. Of most importance are the times when sensor 62 crosses aperture 56 (S1T1 and S1T2) and the times when sensor 64 crosses aperture 58 (S2T3 and S2T4). As in the previous embodiment, the lateral position of printhead 16 in scan direction 33 is calculated from the average of times S1T1 and S2T4. S1T2 and S2T3 could be included in the calculation if needed. The position of printhead 16 in paper feed direction 42 is calculated from the difference between S1T1 and S2T4.

R3 and R4 show the detection range in paper feed direction 42. Gap G1 is set greater than W2 (FIG. 6) if times S1T2 and S2T3 are used. In addition, gap G2 must be set greater than W1 so that the output of sensor 64 does not interfere with the output of sensor 62. In order to minimize overall sensor size, and thus minimize system cost, it is possible to use only times S1T1 and S2T4 in the calculations. Sensors 62, 64 may be electrically connected with little change in the overall operation. The same observations regarding angle selection apply as with a single position sensing element.

Additional information about each printhead can be gained by putting two sensors or sensor pairs on each printhead. The sensors can be placed along path M so that they can share the fixed light source, or an additional light source could be added to the system. Because each sensor determines the location in paper feed direction 42 and the location in scan direction 33 of the printhead, the two sensors can be used to find printhead rotation information, which is significant in determining print quality. Any rotation error causes image misplacement at each swath boundary. The location and rotation information could be used by the printer firmware to correct the image before printing, or it could be used for manual adjustment after each printhead is installed.

Any configuration in which the sensor crosses two aperture edges that are not parallel could be used to determine printhead locations in both paper feed direction 42 and scan direction 33. The arrangement of the present invention provides the optimum sensor sensitivity, range, length and area.

With the system of the present invention, the positions of each of printheads 16, 18, 20 and 22 can be determined. Based on the relative positions of printheads 16, 18, 20 and 22, the print data for each color plane can be adjusted so that final color images are aligned properly on the print medium.

Figure 8:
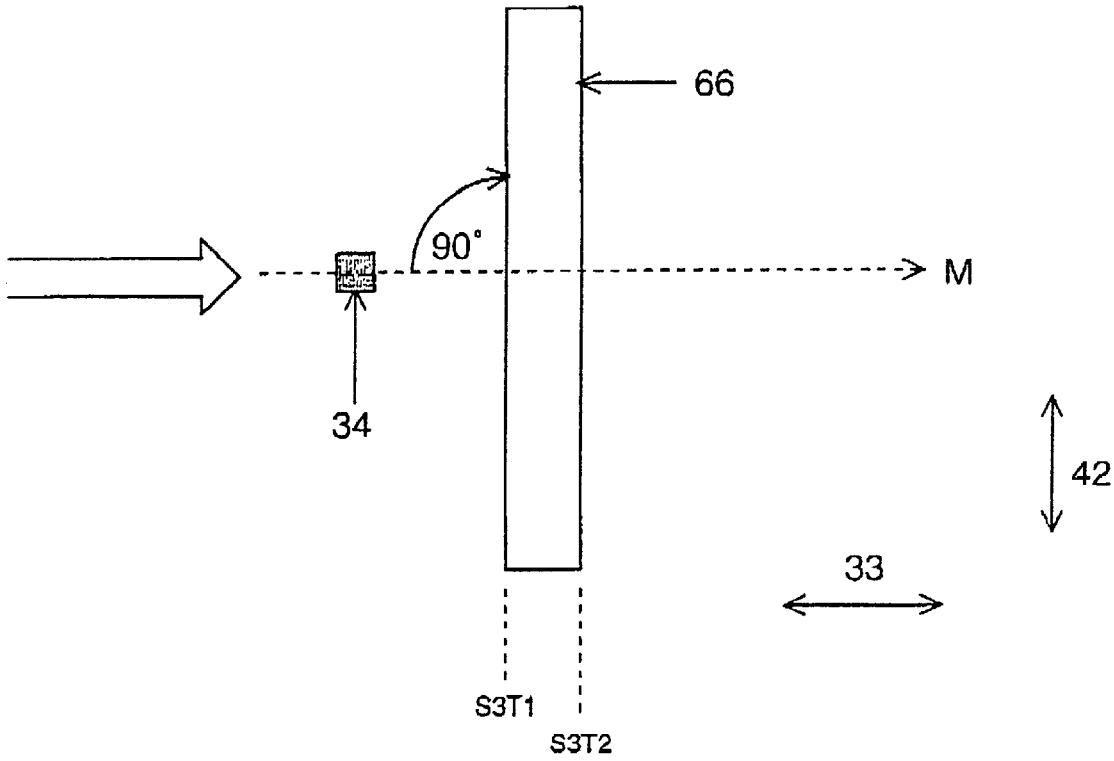
FIG. 8 is an enlarged, top view of another embodiment of an aperture of the light source assembly and the position sensor of FIG. 3.

In yet another embodiment (FIG. 8), the aperture plane includes a single rectangular aperture 66 which is aligned parallel to paper feed direction 42. Thus, sensor 34 detects the position of the printhead only in scan direction 33. Sensor 34 could be extended in paper feed direction 42 in order to increase sensitivity without losing resolution.

Figure 9:
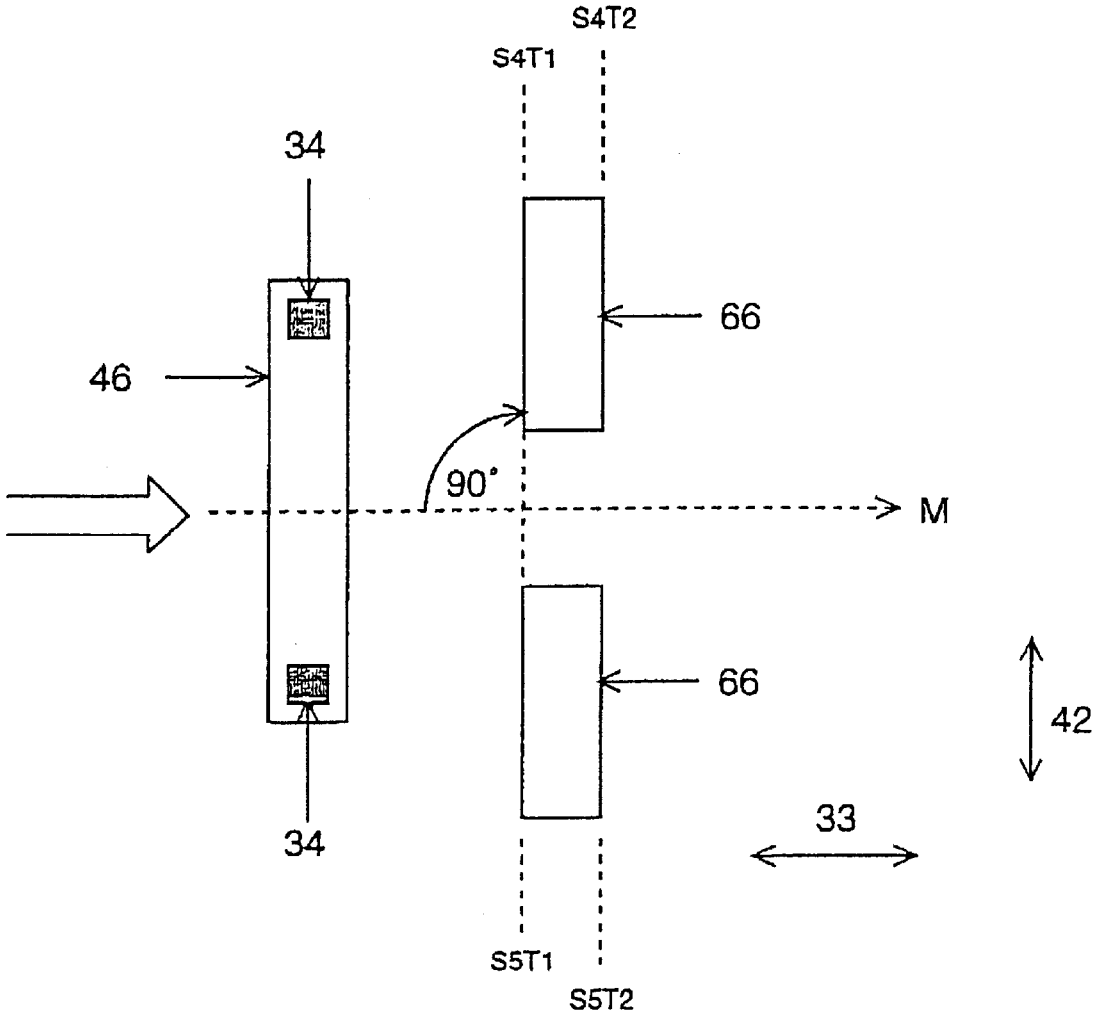
FIG. 9 is an enlarged, top view of another embodiment of the apertures of the light source assembly of FIG. 3 and yet another embodiment of a position sensor assembly.

In a further embodiment (FIG. 9), two position sensors 34 and light sources 66 are displaced in the paper feed direction 42. The two position sensors 34 are part of the same heater chip 46. A difference in the times at which sensors 34 sense the light beam from apertures 66 can be used to calculate the skew of the printhead. Print data to the printhead can then be adjusted accordingly in order to correct for the effects of the skew. Thus, the visible misalignment between the swaths of a skewed printhead can be eliminated.

In a still further embodiment (FIG. 10), a first pair of apertures 56, 58 is displaced in paper feed direction 42 from a second pair of apertures 56, 58. A difference in the times at which sensors 34 sense the light beam from apertures 56 or from apertures 58 can be used to calculate the skew of the printhead. The times at which a sensor 34 detects light from an associated pair of apertures 56, 58 can be used to calculate the position of the printhead in both scan direction 33 and paper feed direction 42.

Figure 11:
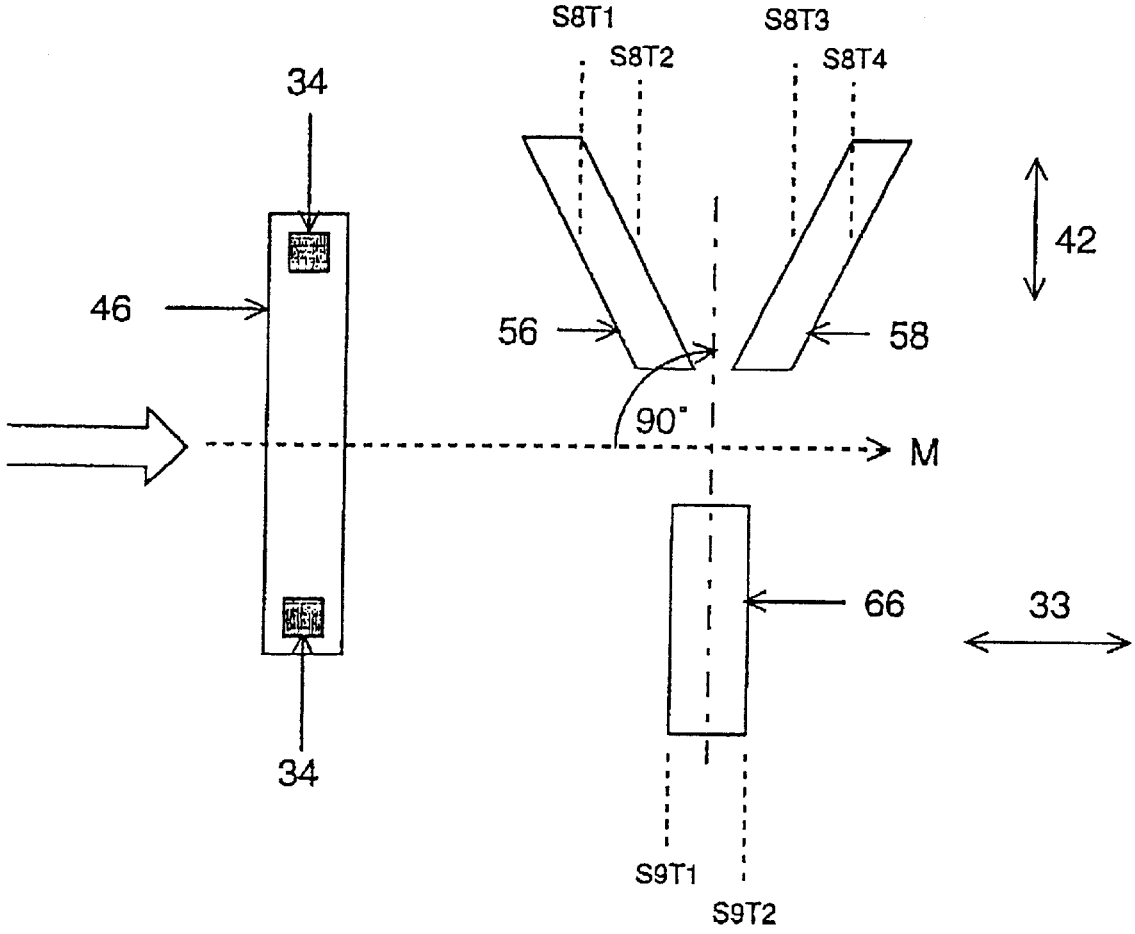
FIG. 11 is an enlarged, top view of a further embodiment of the apertures of the light source assembly of FIG. 3 and the position sensor assembly of FIG. 9.

In another embodiment (FIG. 11), V-shaped apertures 56, 58 are used in conjunction with aperture 66. The light from aperture 66 is sensed by a first position sensor 34, while the light from apertures 56, 58 is sensed by a second sensor 34, with the second sensor 34 being displaced from the first sensor 34 in paper feed direction 42. Thus, the signal from the second sensor 34 is used to calculate the position of the printhead in directions 33 and 42, while the signals from both the first and second sensors 34 is used to calculate the skew of the printhead.

Figure 12:
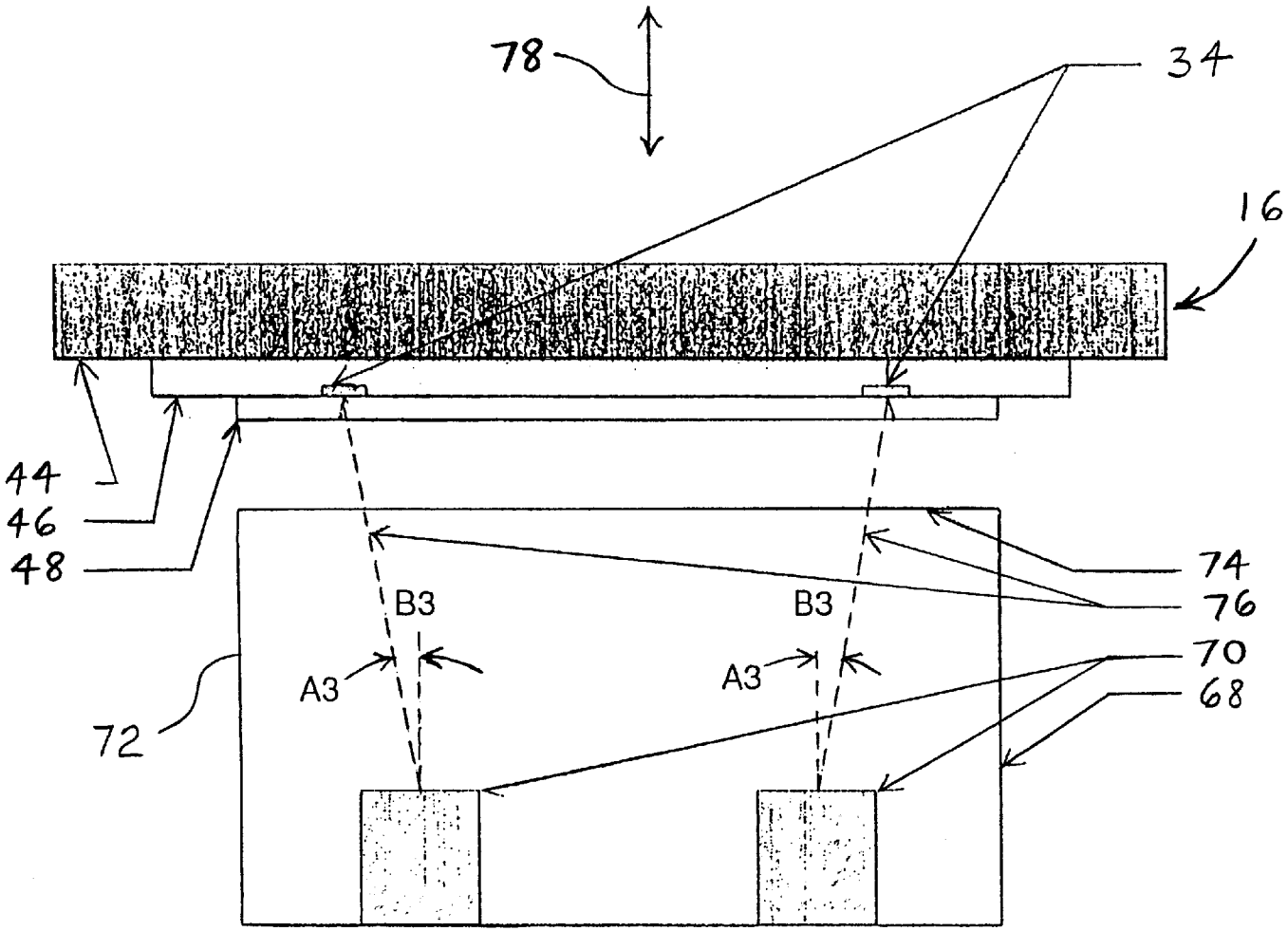
FIG. 12 is a fragmentary, schematic side view of another embodiment of the printhead position detection system of the present invention.

In the embodiments shown above, a light source and sensor arrangement are used to determine the position of a printhead in two horizontal directions, i.e., scan direction 33 and paper feed direction 42. Print defects can also result from variations in printhead elevation due to the change in flight time from the printhead to the print medium. In another embodiment (FIG. 12), position sensors 34 are used to determine the elevation of printhead 16 above a light source assembly 68, and thus the elevation of printhead 16 above the print medium.

Figure 10:
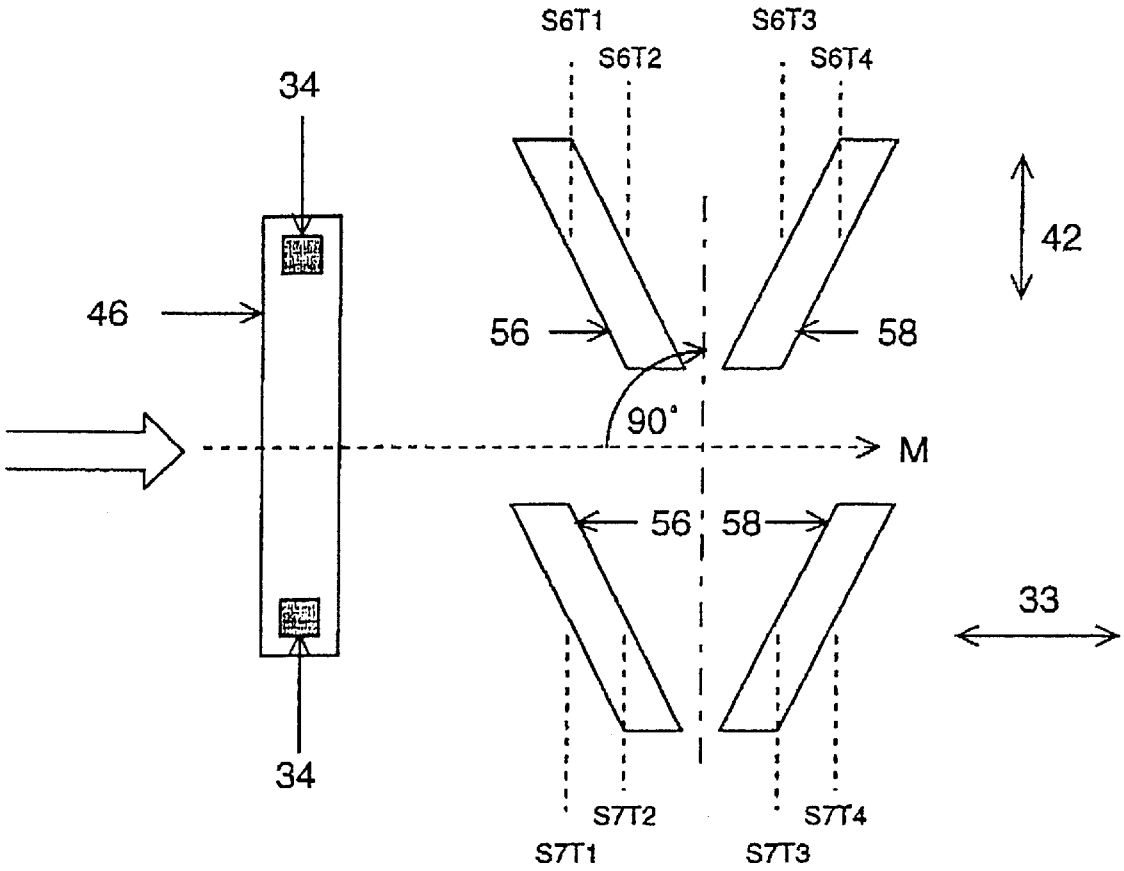
FIG. 10 is an enlarged, top view of yet another embodiment of the apertures of the light source assembly of FIG. 3 and the position sensor assembly of FIG. 9.
Figure 13:
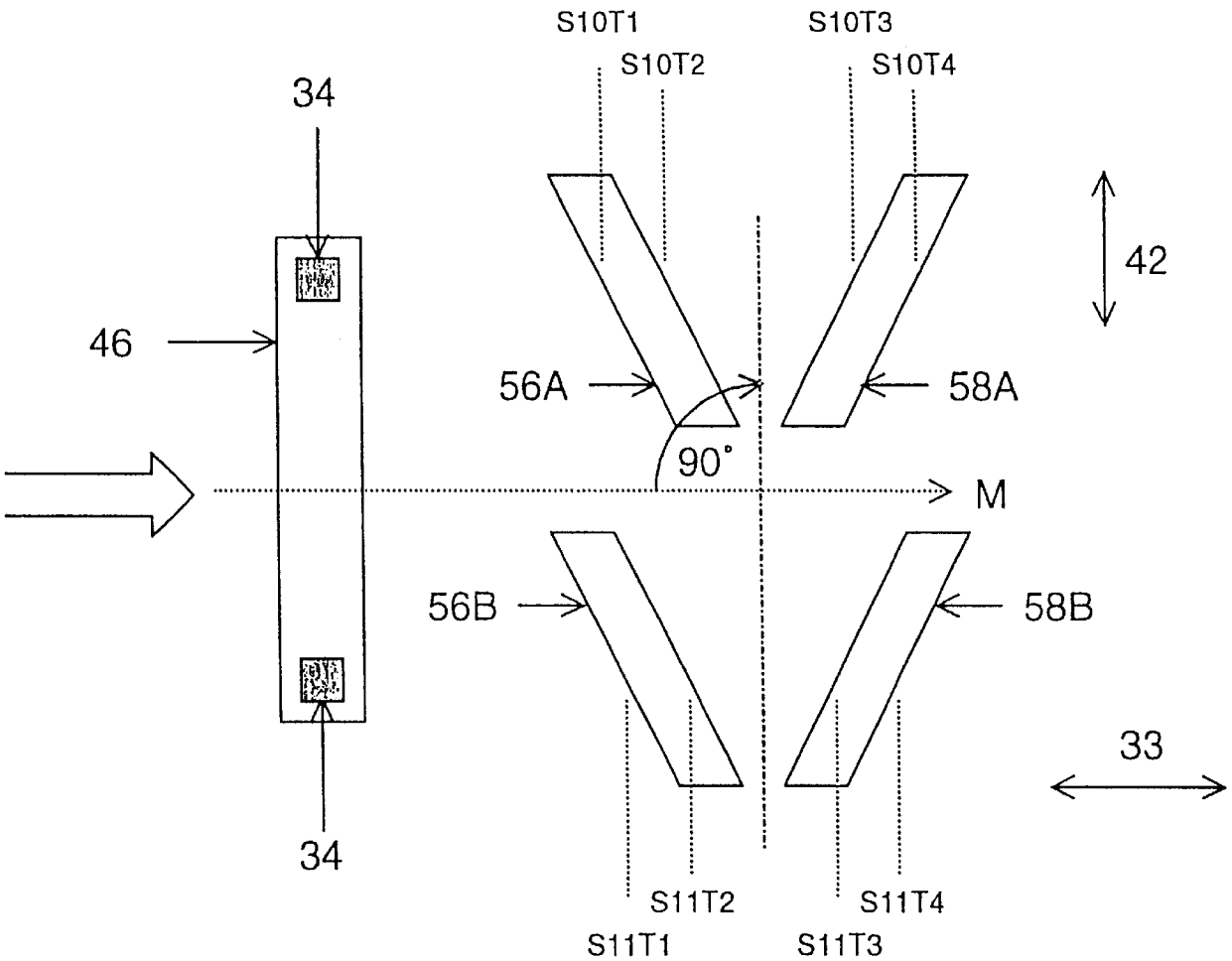
FIG. 13 is an enlarged, top view of one embodiment of the position sensor assembly of FIG. 12 and illumination patterns on the bottom of the heater chip when the light source assembly of FIG. 12 is at a relatively low elevation.
Figure 14:
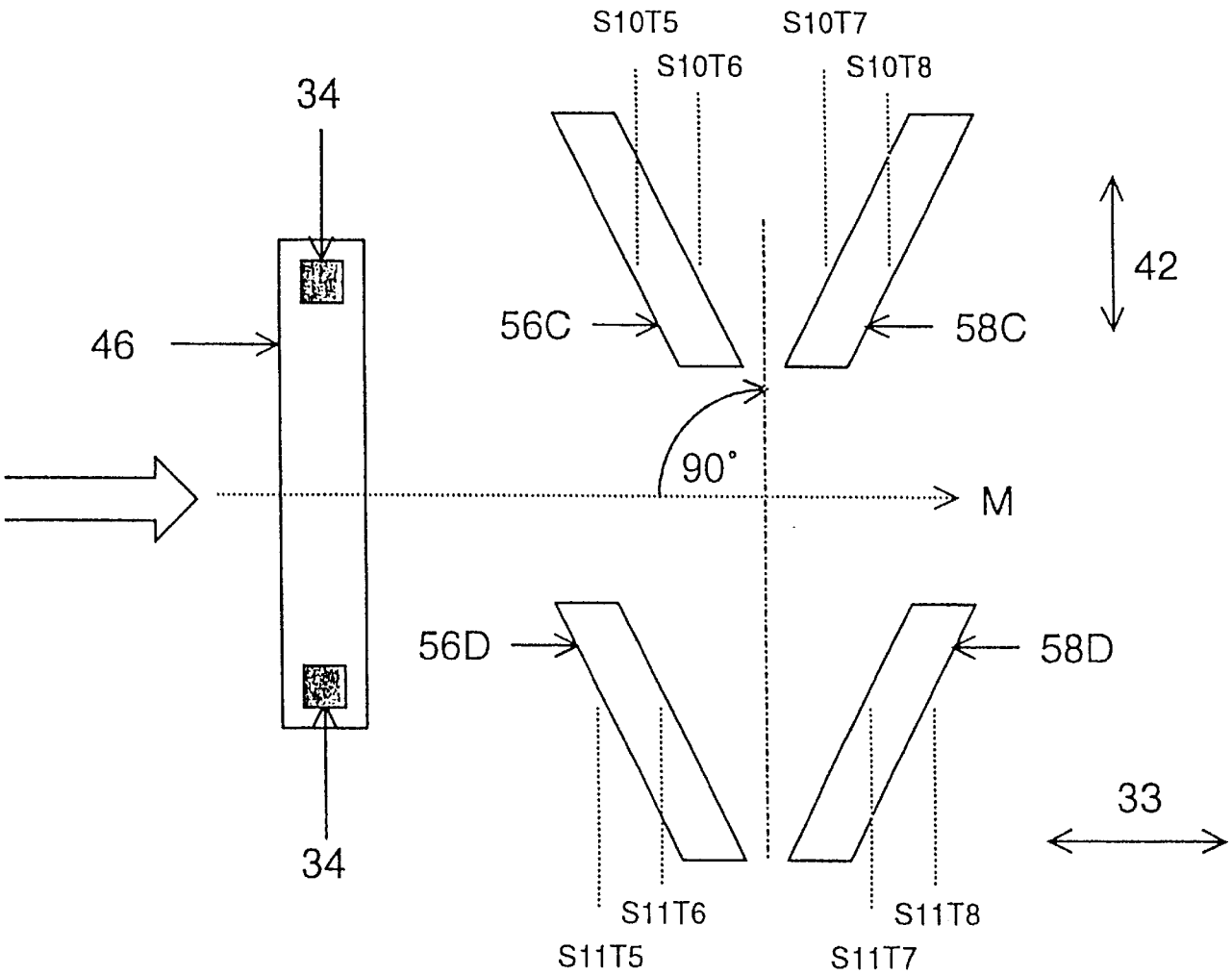
FIG. 14 is an enlarged, top view of the position sensor assembly of FIG. 13 and illumination patterns on the bottom of the heater chip when the light source assembly of FIG. 12 is at a relatively high elevation.

Light source assembly 68 includes two light sources 70 disposed in a housing 72 having an aperture plane 74. In aperture plane 74, a first pair of apertures 56, 58 is displaced in paper feed direction 42 from a second pair of apertures 56, 58, as shown in FIG. 10. Light paths 76, which each define the substantially planar edges of the beams of light, each form an angle A3 with an elevation direction 78. Because the two light sources are not directly below position sensors 34, but are offset by angle A3, the illumination pattern on the bottom of heater chip 46 changes with the elevation above light source assembly 68. FIG. 13 shows the positions of representative illumination patterns 56A, 56B, 58A, 58B on the bottom of heater chip 46 when printhead 16 is at a relatively low elevation. In contrast, FIG. 14 shows the positions of representative illuminations patterns 56A, 56B, 58A, 58B on the bottom of heater chip 46 when printhead 16 is at a relatively high elevation. It can be seen that illumination patterns 56A, 58A are slightly closer to illumination patterns 56B, 58B when printhead 16 is at a relatively low elevation, as shown in FIG. 13.

At the printhead elevation of FIG. 13, sensor data is produced from patterns 56A, 58A at times S10T1, S10T2, S10T3 and S10T4. Further, sensor data is produced from patterns 56B, 58B at times S11T1, S11T2, S11T3 and S11T4. The calculation of printhead position in scan direction 33 and paper feed direction 42 is substantially the same as in previous embodiments. However, the calculation of printhead position in paper feed direction 42 must take into account that the distance between the outermost edges of the illumination patterns, as indicated by times S10T1 and S10T4, for example, vary not only with printhead position in paper feed direction 42, but also with the elevation of printhead 16. For example, the lower the elevation of printhead 16, the longer the difference value V1 between times S10T1 and S10T4, and the shorter the difference value V2 between times S11T1 and S11T4. The average of the difference values [(V1+V2)/2] is constant and does not vary with the elevation of printhead 16. Thus, the position of printhead 16 in paper feed direction 42 is calculated by averaging the difference V1 between times S10T1 and S10T4 and the difference V2 between times S11T1 and S11T4.

The elevation of printhead 16 above light sources 70 varies linearly with the difference between the two time periods (V2−V1). The rate of the linear change is dependent upon offset angle A3.

The timing difference (V2−V1) is negative when printhead 16 is at a relatively low elevation, as in FIG. 13. In the case where printhead 16 is at a relatively high elevation (FIG. 14), the difference between the two time periods (V2−V1) is positive.

Because the drop velocity is much greater than the carriage velocity, for example, more than ten times as great, the image placement error is less sensitive to elevation than it is to errors in the other two dimensions. For that reason, a shallow angle, such as between 2° and 20° is preferred.

Although two light sources 70 are shown herein, it is also possible to use a single light source that is centrally located between the two sensors 34. In this case, the light source assembly would need to be larger to achieve a shallow angle A3. A single light source could also be used with various reflective surfaces to achieve the same effect. Light pipes may also be used to direct the light.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An inkjet printhead position detection system, comprising:

a light emitting device configured to emit at least one beam of light, said at least one beam of light having a first edge and a second edge nonparallel to said first edge; and an inkjet printhead including a light detecting device configured to detect the at least one beam of light as said inkjet printhead scans across said light emitting device, said at least one beam of light being detected a first time when said light detecting device crosses the first edge of the at least one light beam, and said at least one beam of light being detected a second time when said light detecting device crosses the second edge of the at least one light beam.

2. The system of claim 1, wherein said inkjet printhead is configured to scan in a scan direction substantially perpendicular to a print medium feed direction, a time period between the first time when said light detecting device crosses the first edge of the at least one light beam and the second time when said light detecting device crosses the second edge of the at least one light beam being dependent upon a position of said inkjet printhead in the print medium feed direction.

3. The system of claim 2, wherein an average of the first time when said light detecting device crosses the first edge of the at least one light beam and the second time when said light detecting device crosses the second edge of the at least one light beam is dependent upon a position of said inkjet printhead in the scan direction.

4. The system of claim 1, wherein said inkjet printhead is configured to scan in a scan direction substantially perpendicular to a print medium feed direction, a time period between the first time when said light detecting device crosses the first edge of the at least one light beam and the second time when said light detecting device crosses the second edge of the at least one light beam being dependent upon a position of said inkjet printhead in an elevation direction, the elevation direction being substantially perpendicular to each of the print medium feed direction and the scan direction.

5. An inkjet printhead position detection system, comprising:

a light emitting device configured to emit at least one beam of light, said at least one beam of light having a first edge and a second edge nonparallel to said first edge; and an inkjet printhead including a light detecting device configured to detect the at least one beam of light as said inkjet printhead scans across said light emitting device, said at least one beam of light being detected a first time when said light detecting device crosses the first edge of the at least one light beam, and said at least one beam of light being detected a second time when said light detecting device crosses the second edge of the at least one light beam being dependent upon a position of said inkjet printhead, wherein said light emitting device includes at least one aperture defining the at least one light beam, said at least one aperture having two nonparallel sides.

6. The system of claim 5, wherein said at least one aperture comprises two nonparallel slits.

7. The system of claim 6, wherein each said slit has a respective width, a width of said light detecting device being substantially less than either of said slit widths.

8. The system of claim 6, wherein said slits define an angle therebetween, said angle being between 45° and 90°.

9. The system of claim 8, wherein said inkjet printhead is configured to scan in a scan direction substantially perpendicular to a print medium feed direction, a line bisecting the angle between said slits being substantially perpendicular to the scan direction and substantially parallel to the print medium feed direction.

10. The system of claim 9, wherein said light detecting device comprises two nonparallel, elongate light detecting elements, said light detecting elements defining a second angle therebetween, a second line bisecting the second angle, the second line being substantially parallel to the line bisecting the angle between said slits.

11. The system of claim 10, wherein the second angle is approximately equal to the angle defined between said slits.

12. An inkjet printhead position detection system, comprising:

a light emitting device having a fixed position; and an inkjet printhead including a light detecting device configured to detect light from said light emitting device as said inkjet printhead scans across said light emitting device, an amount of the light detected by said light detecting device being dependent upon a position of said inkjet printhead.

13. The system of claim 12, wherein said inkjet printhead scans across said light emitting device in a scan direction, said light emitting device being configured to emit at least one beam of light in a light direction substantially perpendicular to the scan direction.

14. The system of claim 13, wherein the amount of the light detected by said light detecting device is dependent upon a position of said jet printhead in the scan direction.

15. A method of detecting a position of an inkjet printhead, comprising the steps of:

emitting at least one light beam having a first edge and a second edge, the second edge being nonparallel to the first edge;

providing a light detecting device on the inkjet printhead;

scanning the inkjet printhead through said at least one light beam;

detecting the first edge of the at least one light beam with said light detecting device during said scanning step;

detecting the second edge of the at least one light beam with said light detecting device during said scanning step; and calculating the position of the inkjet printhead dependent upon a time period between said detecting steps.

16. The method of claim 15, wherein said scanning is in a scan direction substantially perpendicular to the at least one light beam.

17. The method of claim 16, wherein said scanning step includes moving the light detecting device through the at least one light beam.

18. The method of claim 15, wherein said calculating step includes calculating a position of the inkjet printhead in a print medium feed direction substantially perpendicular to each of the scan direction and the at least one light beam.

19. The method of claim 15, comprising the further step of calculating a position of the inkjet printhead in the scan direction dependent upon an average of a first time at which the first edge of the at least one light beam is detected and a second time at which the second edge of the at least one light beam is detected.

20. The method of claim 15, wherein said calculating step includes calculating a position of the inkjet printhead in an elevation direction substantially perpendicular to the scan direction and print medium feed direction.

21. A method of detecting a position of an inkjet printhead, comprising the steps of:

emitting light from a fixed position within an inkjet printer;

providing a light detecting device on the inkjet printhead;

scanning the inkjet printhead through the light;

detecting the light with said light detecting device during said scanning step; and calculating the position of the inkjet printhead dependent upon said detecting step.

22. A method of detecting a position of an inkjet printhead, comprising the steps of:

emitting light from a fixed position within an inkjet printer;

providing a light detecting device on the inkjet printhead;

scanning the inkjet printhead through the light;

detecting the light with said light detecting device during said scanning step; and calculating the position of the inkjet printhead dependent upon said detecting step, wherein said scanning is in a scan direction, said calculating step including calculating a position of the inkjet printhead in a print medium feed direction substantially perpendicular to the scan direction.

23. The method of claim 22, wherein said emitting step comprises emitting at least one light beam having two nonparallel edges, said detecting step comprising detecting a first time when said light detecting device crosses through a first of said nonparallel edges and detecting a second time when said light detecting device crosses through a second of said nonparallel edges.

24. The method of claim 23, wherein said calculating step is dependent upon a time period between the first time and the second time.

25. The method of claim 23, wherein said calculating step includes calculating a position of the inkjet printhead in the scan direction, said calculating step being dependent upon each of the first time and the second time.

26. A method of detecting a position of an inkjet printhead, comprising the steps of:

emitting light from a fixed position within an inkjet printer;

providing a light detecting device on the inkjet printhead;

scanning the inkjet printhead through the light;

detecting the light with said light detecting device during said scanning step; and calculating the position of the inkjet printhead dependent upon said detecting step, wherein said scanning is in a scan direction, said calculating step including calculating a position of the inkjet printhead in an elevation direction, the elevation direction being substantially perpendicular to a print medium feed direction.

27. The method of claim 26, wherein said emitting step comprises emitting at least one light beam having two nonparallel edges, said detecting step comprising detecting a first time when said light detecting device crosses through a first of said nonparallel edges and detecting a second time when said light detecting device crosses through a second of said nonparallel edges.

28. The method of claim 27, wherein said calculating step is dependent upon a time period between the first time and the second time.

29. A method of printing with an ink jet printer, comprising the steps of:

sensing positions of at least two printheads in the ink jet printer;

adjusting print data dependent upon said sensing step; and printing said adjusted print data with said at least two printheads.

30. A method of printing with an ink jet printer, comprising the steps of:

sensing a skew angle of a printhead in the ink jet printer;

adjusting print data dependent upon said sensing step; and printing said adjusted print data with said printhead.

31. An ink jet printhead position detection system, comprising:

a light emitting device configured to emit a beam of light, the beam of light having a substantially planar edge; and an ink jet printhead including a light detecting device configured to detect the beam of light as said inkjet printhead scans across said light emitting device, said inkjet printhead having a scan direction substantially perpendicular to the substantially planar edge of the beam of light.

32. An inkjet printhead position and skew detection system, comprising:

a light emitting device configured to emit at least one beam of light, said at least one beam of light having a first edge and a second edge nonparallel to said first edge;

an inkjet printhead including two light detecting devices configured to detect the at least one beam of light as said inkjet printhead scans across said light emitting device in a scan direction, said two light detecting devices being offset from each other in the scan direction; and a calculating device configured for calculating the position and skew of the printhead dependent upon a plurality of times at which said light detecting devices cross the first edge and the second edge of the at least one beam of light.

33. A method of detecting position and skew of an ink jet printhead, comprising the steps of:

emitting at least one beam of light having a first edge and a second edge nonparallel to said first edge;

providing an inkjet printhead including two light detecting devices, said two light detecting devices being offset from each other in the scan direction;

detecting the at least one beam of light as said inkjet printhead scans across said light emitting device in a scan direction; and calculating the position and skew of the printhead dependent upon a plurality of times at which said light detecting devices cross the first edge and the second edge of the at least one beam of light.

34. An inkjet printhead position and skew detection system, comprising:

a first light emitting device configured to emit a first beam of light having a first edge and a second edge nonparallel to said first edge;

a second light emitting device offset from said first light emitting device in a paper feed direction, said second light emitting device being configured to emit a second beam of light having a third edge and a fourth edge nonparallel to said third edge;

an inkjet printhead including two light detecting devices offset from each other in the paper feed direction, said light detection devices being configured to detect the first beam of light and the second beam of light as said inkjet printhead scans across said first light emitting device and said second light emitting device in a scan direction; and a calculating device configured for calculating the position and skew of the printhead dependent upon a plurality of times at which said light detecting devices cross the first beam of light and the second beam of light.

35. The system of claim 34, wherein said calculating device is configured for calculating the position of the printhead in a scan direction, in a paper feed direction substantially perpendicular to the scan direction, and in an elevation direction substantially perpendicular to each of the scan direction and the paper feed direction.

36. A method of detecting position and skew of an ink jet printhead, comprising the steps of:

emitting a first beam of light having a first edge and a second edge nonparallel to said first edge;

emitting a second beam of light offset from the first beam of light in a paper feed direction, said second beam of light having a third edge and a fourth edge nonparallel to said third edge;

providing an inkjet printhead including two light detecting devices offset from each other in the paper feed direction;

detecting the first beam of light and the second beam of light as said inkjet printhead scans across said first light emitting device and said second light emitting device in a scan direction; and calculating the position and skew of the printhead dependent upon a plurality of times at which said light detecting devices cross the first beam of light and the second beam of light.

37. The method of claim 36, wherein said calculating step includes calculating the position of the printhead in a scan direction, in a paper feed direction substantially perpendicular to the scan direction, and in an elevation direction substantially perpendicular to each of the scan direction and the paper feed direction.

38. An inkjet printhead position and skew detection system, comprising:

a first light emitting device configured to emit a first beam of light having a first edge and a second edge nonparallel to said first edge;

a second light emitting device offset from said first light emitting device in a paper feed direction, said second light emitting device being configured to emit a second beam of light having a third edge and a fourth edge substantially parallel to said third edge;

an inkjet printhead including two light detecting devices offset from each other in the paper feed direction, said light detection devices being configured to detect the first beam of light and the second beam of light as said inkjet printhead scans across said first light emitting device and said second light emitting device in a scan direction; and a calculating device configured for calculating the position and skew of the printhead dependent upon a plurality of times at which said light detecting devices cross at least one of the first edge and the second edge of the first beam of light and at least one of the third edge and the fourth edge of the second beam of light.

39. A method of detecting position and skew of an ink jet printhead, said method comprising the steps of:

emitting a first beam of light having a first edge and a second edge nonparallel to said first edge;

emitting a second beam of light offset from the first beam of light in a paper feed direction, said second beam of light having a third edge and a fourth edge substantially parallel to said third edge;

providing an inkjet printhead including two light detecting devices offset from each other in the paper feed direction;

detecting the first beam of light and the second beam of light as said inkjet printhead scans across said first light emitting device and said second light emitting device in a scan direction; and calculating the position and skew of the printhead dependent upon a plurality of times at which said light detecting devices cross at least one of the first edge and the second edge of the first beam of light and at least one of the third edge and the fourth edge of the second beam of light.

40. An inkjet printhead position and skew detection system, comprising:

a first light emitting device configured to emit a first beam of light having a first edge and a second edge parallel to said first edge;

a second light emitting device offset from said first light emitting device in a paper feed direction, said second light emitting device being configured to emit a second beam of light having a third edge and a fourth edge substantially parallel to said third edge;

an inkjet printhead including two light detecting devices offset from each other in the paper feed direction, said light detection devices being configured to detect the first beam of light and the second beam of light as said inkjet printhead scans across said first light emitting device and said second light emitting device in a scan direction; and a calculating device configured for calculating the position in the scan direction and skew of the printhead dependent upon a plurality of times at which said light detecting devices cross at least one of the first edge and the second edge of the first beam of light and at least one of the third edge and the fourth edge of the second beam of light.

41. A method of detecting position and skew of an ink jet printhead, comprising the steps of:

emitting a first beam of light having a first edge and a second edge parallel to said first edge;

emitting a second beam of light having a third edge and a fourth edge parallel to said first edge, the second beam of light being offset from the first beam of light in a paper feed direction;

scanning an inkjet printhead including two light detecting devices across the at least one beam of light in a scan direction, said two light detecting devices being offset from each other in the scan direction;

detecting the at least one beam of light during said scanning, and calculating the position in the scan direction and skew of the printhead dependent upon a plurality of times at which said light detecting devices cross at least one of the first edge and the second edge of the first beam of light and at least one of the third edge and the fourth edge of the second beam of light.

* * * * *